United States Patent [19]

Benedek et al.

[11] 4,171,100

[45] Oct. 16, 1979

[54] ELECTROSTATIC PAINT SPRAYING APPARATUS

[75] Inventors: György Benedek; András Bese; József Domokos; István Kovács, all of Budapest, Hungary

[73] Assignee: Hajtomuvek es Festoberendezesek Gyara, Budapest, Hungary

[21] Appl. No.: 849,016

[22] Filed: Nov. 7, 1977

[30] Foreign Application Priority Data

Nov. 10, 1976 [HU] Hungary ..... HA 1029

[51] Int. Cl.[2] ..... B05B 5/04

[52] U.S. Cl. ..... 239/700; 239/703; 239/707; 361/227

[58] Field of Search ..... 239/3, 690–706; 361/225–228; 118/621, 626, 629; 427/13, 21, 27, 30, 31

[56] References Cited

U.S. PATENT DOCUMENTS

| | | | |
|---|---|---|---|
| 2,742,185 | 4/1956 | Landry | 427/27 X |
| 3,735,925 | 5/1973 | Benedek et al. | 239/706 |
| 3,843,054 | 10/1974 | Kendall et al. | 239/708 |

FOREIGN PATENT DOCUMENTS

| | | | |
|---|---|---|---|
| 1239218 | 4/1967 | Fed. Rep. of Germany | 239/698 |
| 909474 | 10/1962 | United Kingdom | 239/697 |
| 1376637 | 12/1974 | United Kingdom | 239/706 |
| 1459679 | 12/1976 | United Kingdom | 239/707 |
| 504561 | 4/1976 | U.S.S.R. | 239/706 |

*Primary Examiner*—Robert B. Reeves
*Assistant Examiner*—Andres Kashnikow
*Attorney, Agent, or Firm*—Poms, Smith, Lande & Rose

[57] ABSTRACT

Electrostatic spraying apparatus comprises a rotary spraying head and a multiple electrode arrangement which includes two high voltage electrodes one of which has an uninsulated portion, and a grounded electrode. A paint flow space is defined between the uninsulated portion and the grounded electrode as well as the remainder of the one high voltage electrode and the grounded electrode. The second high voltage electrode is spaced outwardly from the grounded electrode and has an insulating layer both on its outer side and on its side facing the grounded electrode.

8 Claims, 5 Drawing Figures

ELECTROSTATIC PAINT SPRAYING APPARATUS

BACKGROUND OF THE INVENTION

1. Field of the Invention

The invention concerns electrostatic paint spraying apparatus. The word "paint" as used in this specification and claims should be interpreted broadly as covering any coating material to be sprayed on to the surface of a workpiece or object, for whatever purpose e.g. protection or decoration.

2. Description of the Prior Art

In the field of electrostatic paint spraying a variety of spraying heads are known. Rotary spraying heads may be shaped as a bell, mushroom, dish or disc. A common characteristic of these rotary devices is that the paint is atomized partially by the centrifugal force and partially by electrostatic forces. In the electrostatic force field the paint is formed into a film at an appropriately shaped atomizing edge and the thin film of paint leaving the edge is transformed into a mist of very fine droplets.

Known spraying devices may be made of metal or plastics. The spraying edge of a metallic spraying device is generally made sharp and is connected to high voltage current source the other pole of which is grounded. Thus the metallic spraying device has a very high potential relative to ground, e.g. 50 to 150 kV. The object to be coated is also ground and positioned in front of the spraying device at a distance of about 250–400 mm to form an extremely strong electric force field with the spraying device connected to high voltage. The average field intensity is given by the ratio of the potential difference and the distance which thus in the case of 100 kV and 300 mm is 3.3 kV/cm. However, this value of the field intensity is considerably enhanced at the sharp edge of the spraying device as a consequence of the so-called electric corona effect and can exceed the breakdown potential of air. Thus, at the atomising edge the electric charge flows into the air accompanied by a corona discharge. If paint is present at this edge, then the very high field intensity causes the paint to form into a ribbon or filament which then is transformed from droplets into a standing paint cloud in the manner already described.

Where the spraying device is made of plastics, then the paint layer itself forms the conductive or semi-conducting layer which conveys the charge to the edge of the spraying device. There the ribbon and cloud formation takes place in a manner similar to that already described. With plastics spraying devices, especially where the resistance of the paint to be sprayed is high, the field strength at the edge of the surface is smaller and thus the efficiency of spraying is reduced. The efficiency of a plastics spraying device depends more on the specific resistivity of the paint employed i.e with such devices only paints in a narrower resistivity range can be sprayed.

Electrostatic spraying devices are also known which rotate at very high speed, of the order of 20,000–30,000 r.p.m., and where spraying takes place exclusively under the effect of the high centrifugal forces while the electrostatic charge is imparted to the spray mist indirectly and only after separation from the rotary edge.

Another known method of electrostatic spray painting is the so-called auxiliary electrode system wherein the high electric field strength necessary for charging the paint is produced by a main and auxiliary electrode connected to opposite polarities and disposed relatively close to each other.

An advanced type of system is a so-called capacitor type electrode arrangement wherein the paint is in direct contact with the main electrode and a solid dielectric layer is between the auxiliary electrode and the paint, see U.S. Pat. No. 3,735,925 (=GB-PS No. 1,335,071=DT-PS No. 2,059,594 and others). Because of the small distance between the electrodes in this arrangement, extremely high field strengths can be achieved in spite of the use of relatively small voltages and thus in this system high electric charges can be imparted to the paint cloud with operating voltages of only 15–30 kV, i.e. smaller than conventional voltages.

While this system is suitable for various kinds of electrostatic spraying devices it has been used primarily with air atomizing devices. This is because air atomization imparts to the paint cloud a characteristic initial velocity and direction of advance which causes the paint cloud to pass into the vicinity of the object to be coated where the charge carried by the paint droplets is in itself sufficient for deposition on the surface of the object.

In this system, the atomized paint cloud has a very high charge. However, any insulated or grounded object or metallic body attracts the electrically charge paint cloud and thus it is not only the object to be coated that attracts the paint particles but also the counter-electrode of the capacitor system, which is also grounded. Where atomization takes place primarily under the effect of electrostatic forces and the paint cloud leaves the spraying device at a relatively low speed only, the vicinity of the grounded electrode and its charge of opposite polarity exerts a very strong attraction on the cloud and a part thereof is thus deposited on the surface of the insulating layer covering the electrode. Thus, a part of the atomized paint is deposited back on the spraying device.

SUMMARY OF THE INVENTION

An aim of the invention is to eliminate or reduce the defects of both kinds of paint spraying apparatus and to provide apparatus which unites or combines the advantages of the two above-described types of paint spraying apparatus while eliminating or reducing their drawbacks. In other words, an aim of the invention is the development of spray painting apparatus which utilizes the advantages of a capacitor type electrode system and provides high charging with low voltage while avoiding the "spray back" arising with low discharge velocity spray atomization systems. A further aim of the invention is the improvement of the apparatus from the point of view of protection against sparks or fires, that is to say the elimination of a free-standing unprotected or approachable high voltage electrode and thus the prevention of sparking.

The invention is based on the discovery that the above aims may be satisfied by utilizing an electrode system consisting of multi-layer, mutually insulated electrodes wherein the two outer electrodes are connected to high potential while a grounded electrodes is in the middle between the two high voltage electrode in such a manner that it has no externally acting electric field or effect. In use, the paint passes between the insulation of the central earthed grounded electrode and the outer high voltage electrodes, while for a part of its path it is in direct contact with the latter.

Accordingly, one aspect of the invention consists in a paint spraying apparatus comprising a spraying head, a multiple electrode arrangement including two high voltage electrodes, one of which has at least a portion that is not insulated, a grounded electrode, and a paint flow space defined partly by said uninsulated portion of one of the high voltage electrodes, and by said grounded electrode. The second high voltage electrode is spaced outwardly from the grounded electrode and is provided with an insulating layer both on its outer side and on its side facing said grounded electrode.

The essence of the preferred embodiments of the invention is that there is a second high voltage electrode next to the insulated electrode separated from the latter and from the outside by an insulating layer. As, therefore, the grounded electrode is covered with insulation on both sides, it is screened by the high voltage electrodes and thus outwardly only the high voltage electrodes have a force field, and those also only through an insulating layer.

DESCRIPTION OF THE PREFERRED EMBODIMENTS

Like or functionally equivalent parts have been allotted the same reference numbers throughout.

Figure 1:
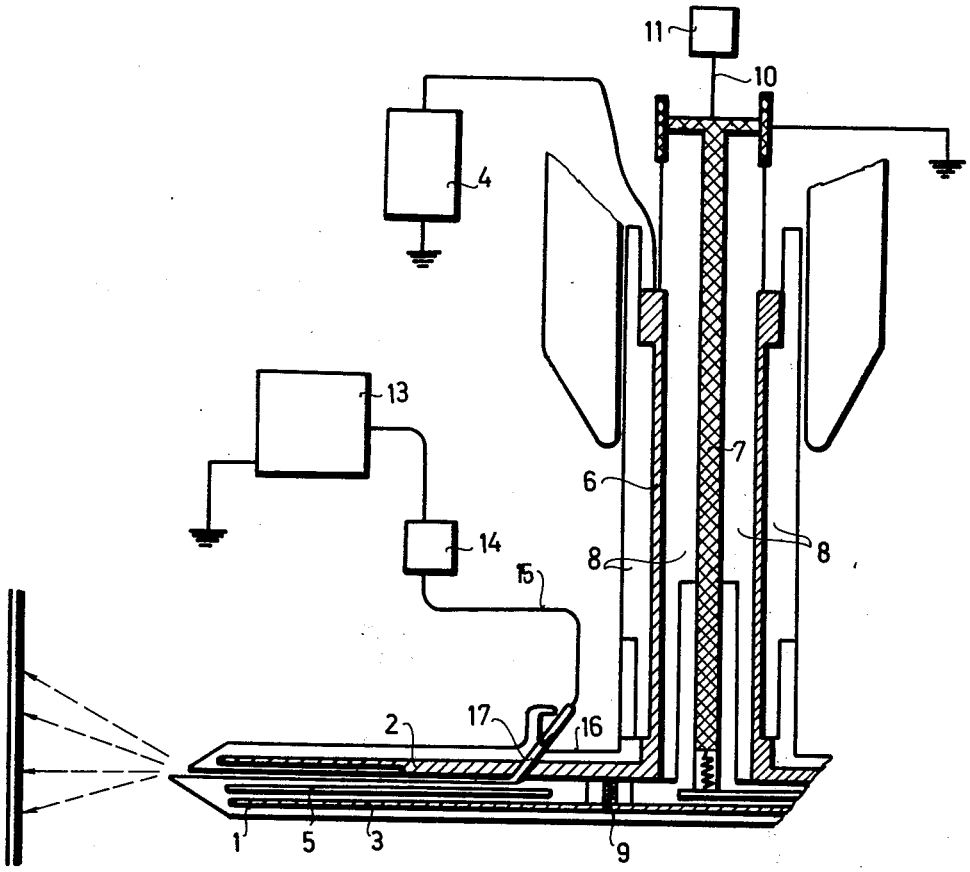
FIG. 1 shows a cross-section of a first preferred embodiment of apparatus according to the invention, having a disc-type rotary atomising edge.

Referring first to FIG. 1, there is shown an electrostatic paint spraying apparatus having a rotary disc-like paint discharge edge, wherein the disc has a multi-layer construction including three electrodes 2, 3 and 5 each of which is covered with an insulating layer 1. The two outer electrodes 2 and 3 are connected to the same pole of a high voltage supply 4. A grounded electrode 5 is disposed between the high voltage electrodes 2 and 3.

From the point of view of electrostatically charging the paint, the arrangement is such that the grounded electrode 5 cooperates with the high voltage electrode 2, that is to say a space is formed therebetween for paint flow while the other high voltage electrode 3 merely exerts a guiding effect on the charged paint cloud. The high voltage electrode 2 is extended rearwardly in the form of a tubular casing 6 in which is disposed a drive shaft 10 connected to a motor 11 for rotating the disc. The connection 7 of the grounded electrode 5 is disposed with the shaft 10. The parts 6 and 7 are insulated from each other as well as from the outside by means of respective insulating layers 8 and these parts 6 and 7 surround the shaft, also of insulating material, at a suitable distance from each other. The parts 6, 7 are of annular form. The high voltage and ground contacts are connected to the annular parts 6, 7 by sliding contacts.

The two high voltage electrodes 2 and 3 are in metallic (conductive) contact with each other by way of a spring 9. The spring 9 passes through a large-diameter transverse bore formed in the grounded electrode 5 so as to ensure reliable insulation at the operating conditions. The paint is stored in a grounded paint tank 13 and is connected to the apparatus by means of a paint metering or supply device 14 and a flexible tube 15. A paint cup 16 disposed on the outside of the apparatus serves to accept the paint and bores 17 pass therefrom into the space between the high voltage electrode 2 and the grounded electrode 5.

The paint supply device 14 is a mechanical device, expediently a pump and in use passes the paint via the tube 15, the cup 16 and the bores 17 to the paint space between the electrodes 2 and 5. Here the paint passes along a path where it is in direct contact with the high voltage electrode 2 to receive its charge by a capacitor-like effect, as explained in greater detail in the aforesaid patent. The charge is strongly concentrated on the side of the paint lying adjacent the insulated electrode by the attraction from the oppositely lying and oppositely charged, i.e. grounded, electrode.

As the paint continues to advance it leaves the "bare" part of the electrode 2 but the grounded part of the electrode 2 holds the high charge density on the side of the paint adjacent thereto. This charge density becomes free only when the paint has flowed past the grounded electrode and passed out of the outer atomizing edge of the apparatus. Here the electrostatic charge and the centrifugal force together atomize the paint. Because of its polarity, the flow of paint towards the object to be coated is assisted by the two outer high voltage electrodes of the same polarity.

Figure 2:
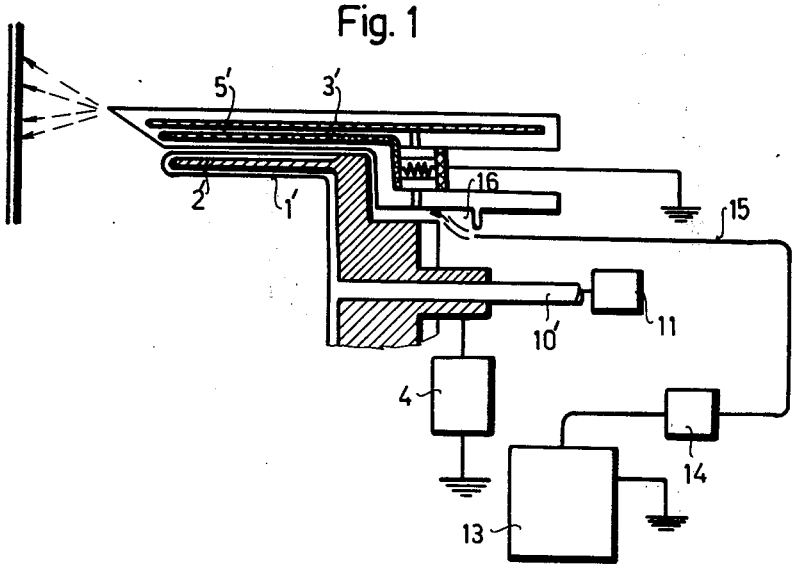
FIG. 2 shows a cross-section of a second preferred embodiment of the apparatus according to the invention having a bell-like rotary edge.

In the FIG. 2 embodiment, the electrodes 2', 3' and 5' are in a bell-like arrangement and the Figure shows only half of the apparatus along a longitudinal section. Here the high-voltage electrode 2' and the electrode 3' metallically connected thereto, called in the present case a jacket electrode, are connected to a high voltage generator 4. Between them the grounded electrode 5' is arranged. It is grounded by being passed through a bore formed in a connecting rib that connects the electrodes 2' and 3', the rib being, of course, suitably insulated. In use, the paint is caused to pass from tank 13 via device 14 and line 15 into a cup 16 arranged on the outer portion of the bell, from which it passes via through-flow openings into contact with the high voltage electrode 2 and then between it and the grounded electrode 5 to the outer edge of the bell.

The paint flowing between these electrodes receives its charge in the manner already described. Atomization of the paint also takes place in the manner already described. The atomized paint is repelled by the outer high voltage electrode 3' and guides the paint to the object to be coated towards the vertical plane perpendicular to the axis of rotation of the bell.

In this embodiment also, each electrode is provided with an insulating layer 1' and is thus insulated both relative to other electrodes and relative to the outside. The exception is the section of the high voltage electrode 2' which is in direct contact with the paint. As before, the bell is rotated by a shaft 10' driven by a motor 11. In this embodiment also, sliding contacts provide electrical connections.

Figure 3:
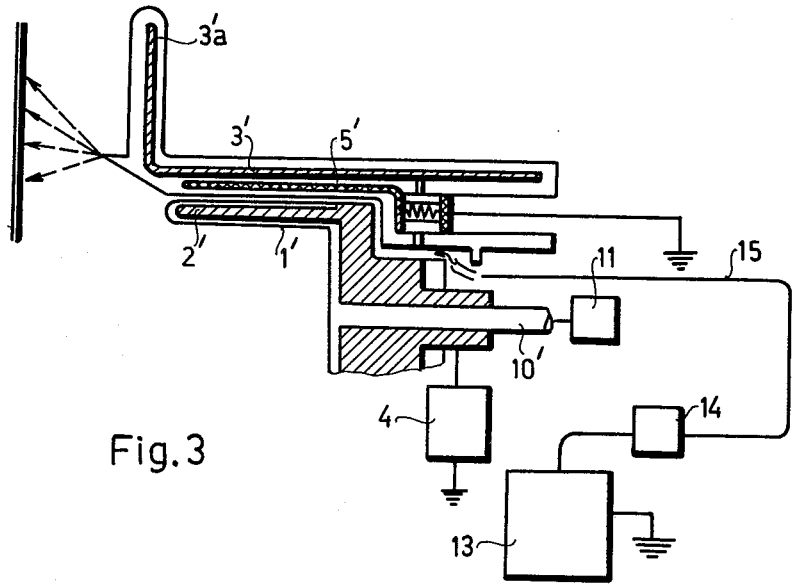
FIG. 3 is a cross-section of a variant of the embodiment shown in FIG. 2.

The FIG. 3 embodiment is essentially the same as that of FIG. 2 with the only difference that, in order to increase the efficiency of guiding the paint, the high voltage outer electrode 3' is provided with an outturned transverse flange 3'*a* to provide a kind of end or baffle surface. Naturally the flange 3'*a* is insulated also.

Figure 4:
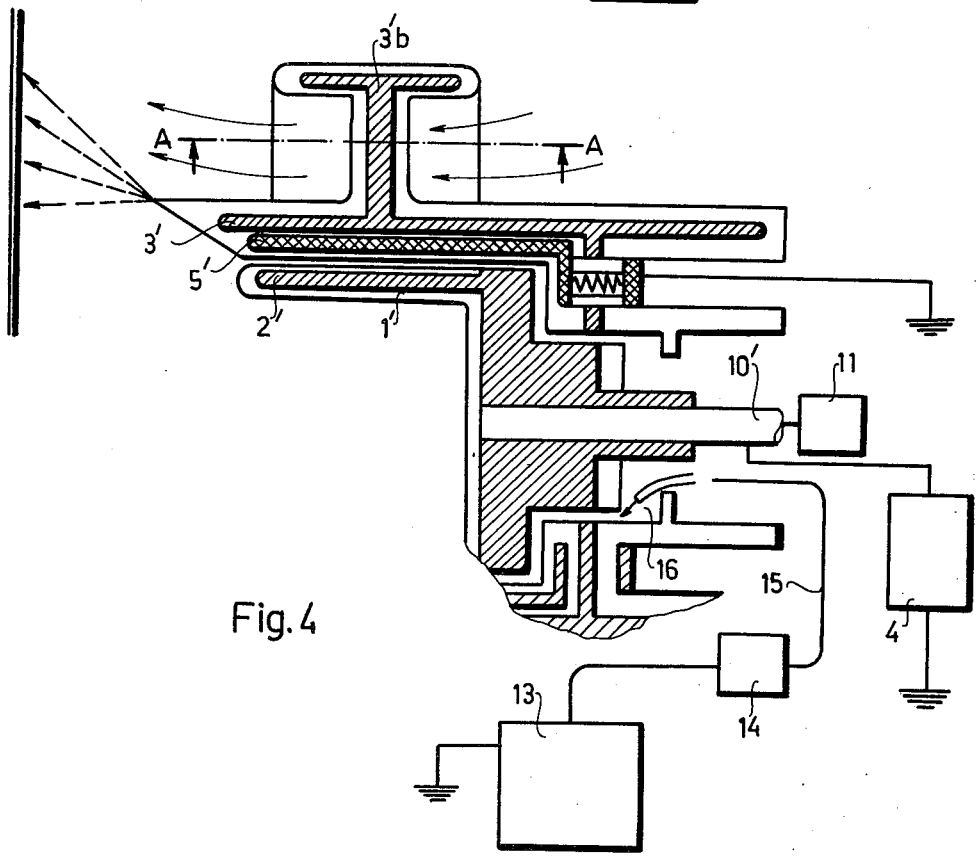
FIG. 4 is a cross-section of a variant of the embodiment of FIG. 2, supplemented by means assisting or inducing air flow.
Figure 5:
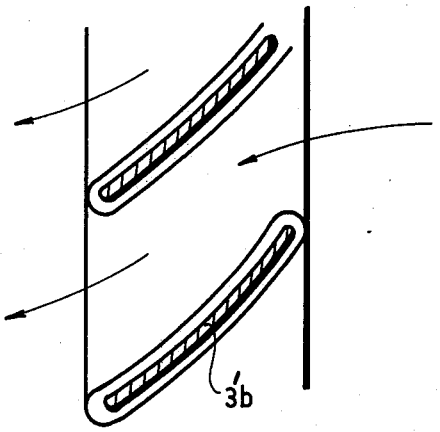
FIG. 5 is a section taken along the plane A—A of FIG. 4.

The embodiment of FIG. 4 also essentially agrees with that of FIG. 2 with the only significant difference being that, in order to promote air flow, the outer high voltage electrode 3' is connected to a ring **3'*b* of axial flow blades forming part thereof. The blade ring 3'*b* is also insulated. FIG. 5 shows the section of the blade ring 3'*b*** along the plane parallel with the axis of rotation.

In use, the rotating blades of blade ring **3'*b* move the air and drive it towards the edge while the electrode 3' and the blades of blade ring 3'*b*** connected to high voltage guide the paint cloud discharged from the edge.

We claim:

1. Electrostatic spraying apparatus comprising a spraying head, a multiple electrode arrangement forming part of said head and including two high voltage electrodes one of which has at least a portion that is uninsulated; a further electrode that is grounded; a paint flow space in said head defined partly by said uninsulated portion of one of the high voltage electrodes and by said grounded electrode, the other of said high voltage electrodes being spaced outwardly from the grounded electrode and being provided with an insulating layer both on its outer side and on its side facing said grounded electrode; and, an insulated airflow blade ring formed and electrically connected as a high voltage electrode, the blade ring being mechanically connected to the outer high voltage electrode.

2. Apparatus according to claim 1, wherein one of the two high voltage electrodes extends beyond the other in the direction of paint flow.

3. Electrostatic spraying apparatus comprising a rotary spraying head, a drive shaft of insulating material, said rotary head being connected for rotation to said drive shaft, a multiple electrode arrangement forming part of said head and including two high voltage electrodes one of which has at least a portion that is uninsulated; a further electrode which is grounded; and a paint flow space in said head defined partly by said uninsulated portion of one of the high voltage electrodes and by said grounded electrode, the other of said high voltage electrodes being spaced outwardly from the grounded electrode and being provided with an insulating layer both on its outer side and on its side facing said grounded electrode.

4. Apparatus according to claim 3 wherein said head is a rotary disc-shaped member that includes the electrode means.

5. Apparatus according to claim 3 wherein said rotary head is formed as a bell that includes the electrode means.

6. Apparatus according to claim 3 wherein the high-tension electrodes are connected to a common high-tension source.

7. Apparatus according to claim 3 wherein the high-tension electrodes are connected with each other.

8. Apparatus according to claim 3, wherein one of the two high voltage electrodes extends beyond the other in the direction of paint flow.

* * * * *